United States Patent [19]

Israel et al.

[11] Patent Number: 4,887,409

[45] Date of Patent: Dec. 19, 1989

[54] METHOD AND MEANS FOR MAKING SEGMENTED COSMETIC ARTICLES

[75] Inventors: Gary Israel, West Nyack, N.Y.; Andrew Nadzan III, Union, N.J.; William Deierlein, Monsey, N.Y.

[73] Assignee: Avon Products, Inc., New York, N.Y.

[21] Appl. No.: 211,328

[22] Filed: Jun. 24, 1988

[51] Int. Cl.[4] ..... B65B 1/24

[52] U.S. Cl. ..... 53/436; 53/237; 53/474; 53/527; 100/918; 141/9; 141/12; 141/80; 141/105; 264/113; 264/245; 425/356; 425/431; 425/443; 425/447

[58] Field of Search ..... 53/436, 474, 473, 527, 53/523, 237; 100/918; 141/12, 9, 105, 80; 426/249, 285, 512; 264/113, 245, 120, 254, 267, 268; 425/131.1, 130, 441, 443, 425, 431, 434, 448, 449, 447, 356

[56] References Cited

U.S. PATENT DOCUMENTS

| | | | |
|---|---|---|---|
| 1,547,260 | 7/1925 | Nighthart | 425/356 X |
| 2,145,240 | 1/1939 | Adams | 141/9 |
| 3,405,744 | 10/1968 | Bowman | 53/527 X |
| 3,877,862 | 4/1975 | Murray | 425/448 |
| 4,050,865 | 9/1977 | Drostholm et al. | 264/120 X |
| 4,390,488 | 6/1983 | Wessel | 264/120 X |
| 4,666,723 | 5/1987 | Invernizzi et al. | 53/237 X |

*Primary Examiner*—James F. Coan
*Attorney, Agent, or Firm*—S. Michael Bender

[57] ABSTRACT

Segmented cosmetic articles are made by positioning an empty pan at the bottom of a sleeve having interior partitions forming separate compartments or chambers extending longitudinally the full extent of the sleeve, with respect to the pan. A ram or piston assembly having corresponding charge of loose powder (each preferably of different color) through the end of the sleeve distal with respect to the pan. A ram or piston assembly havin solid segments conforming in shape to each separate chamber then is slidably received within the sleeve through the opening through which loose powder is admitted, and telescopically advanced relative to the sleeve toward the pan at other end thereof sufficient to pre-press or partially compress the powder charge into the pan. By this action, all segments of powder corresponding to the charge in each chamber of each sleeve, respectively, are partially compressed simultaneously. The sleeve is then moved telescopically relative to the piston assembly away from the pan and the pre-pressed segments therein thereby permitting the pan to be subsequently engaged by a second piston assembly having a shape congruent to the shape of the pan mouth effective to finally compress the prepressed multi-colored segements therein.

9 Claims, 4 Drawing Sheets

FIG. 1
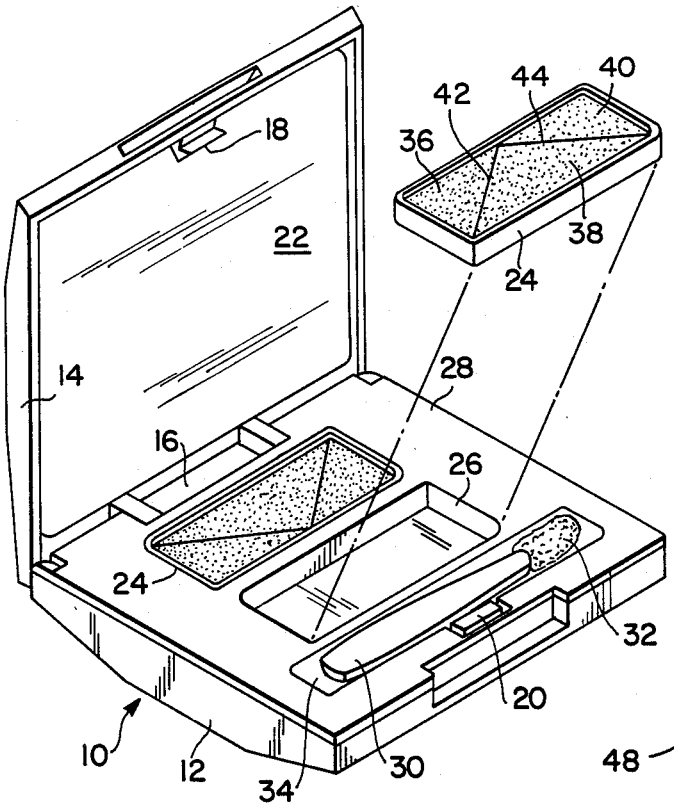
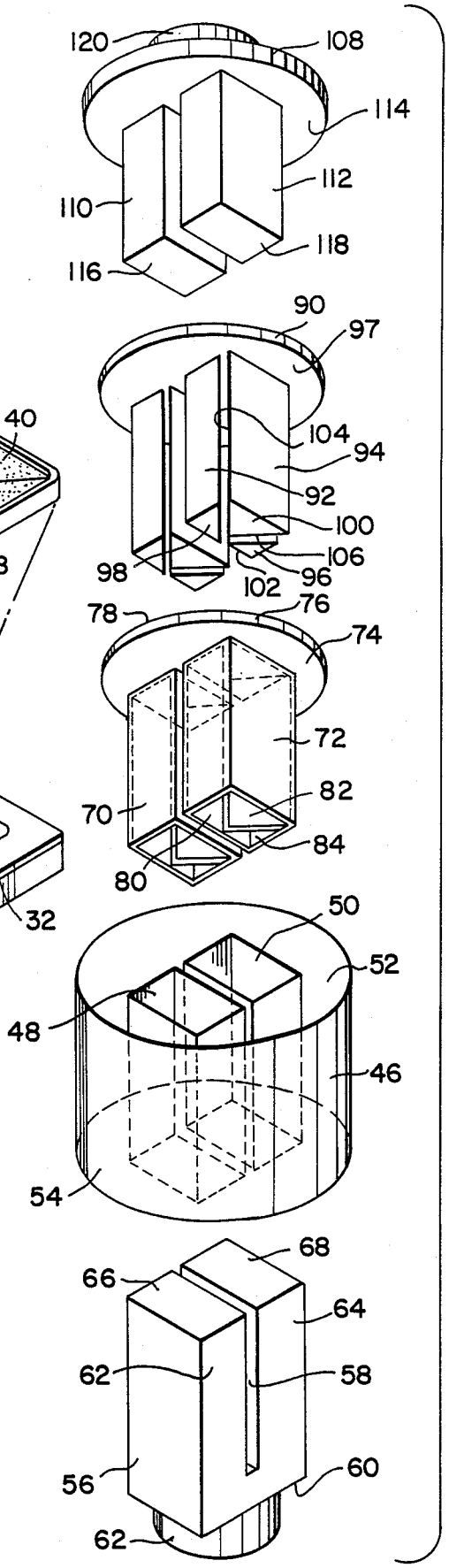
FIG. 2

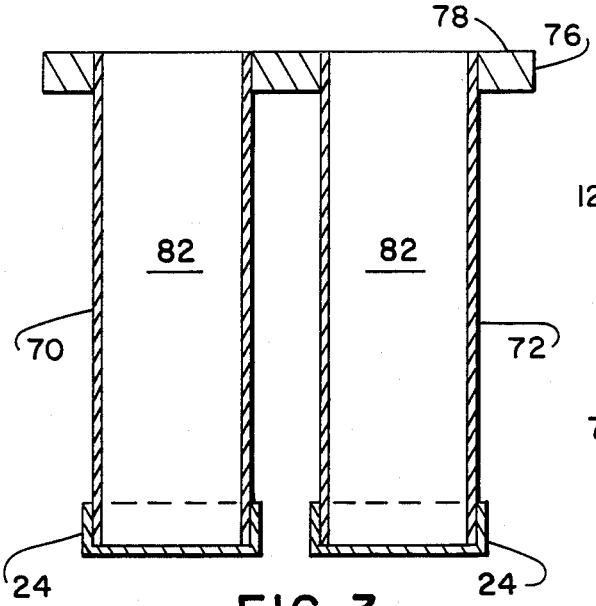
FIG. 3
FIG. 4A
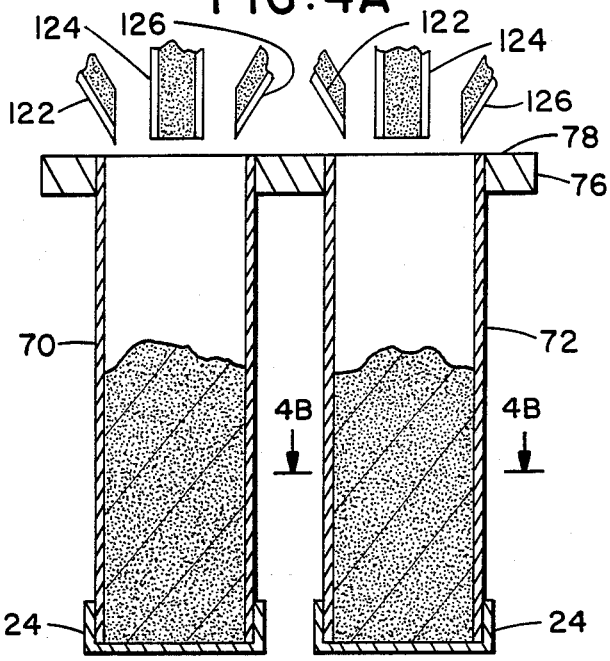
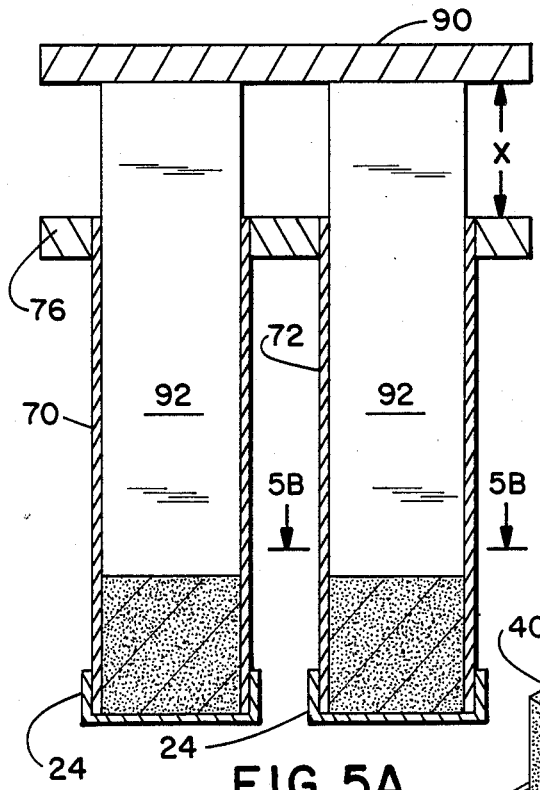
FIG. 5A
FIG. 5B
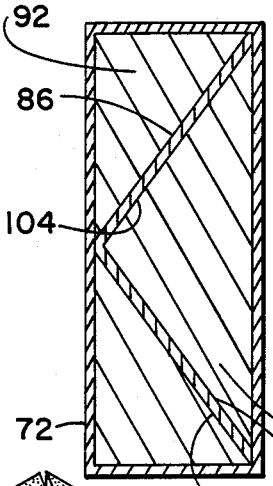
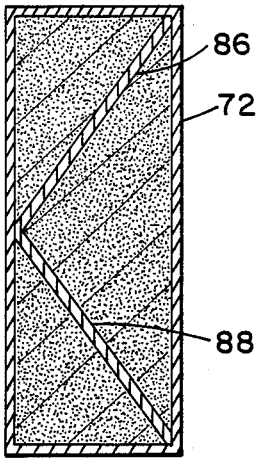
FIG. 4B
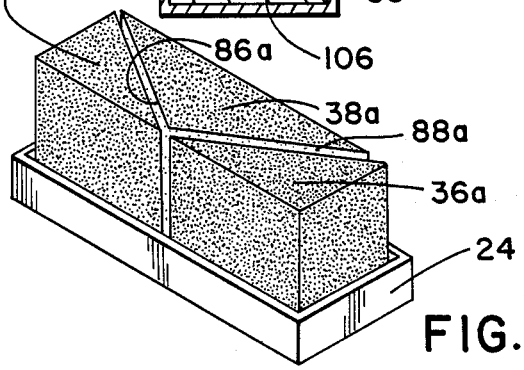
FIG. 5C

METHOD AND MEANS FOR MAKING SEGMENTED COSMETIC ARTICLES

TECHNICAL FIELD

The present invention relates generally to cosmetic articles, and more particularly, to a novel method and means for making cosmetic articles of the type useful for applying color to the skin. The articles contemplated by the present invention generally are sold to consumers in small portable containers commonly referred to as "compacts" in which the cosmetic article is stored as a compressed powder prior to application to the surface of the skin. The cosmetic article may comprise eyeshadow, face powder, blush, rouge or any other known cosmetic material susceptible of being formed and stored in compressed powder mode. Even more particularly, the cosmetic articles contemplated comprise multiple segments of cosmetic material of any desirable shape or pattern, and preferably are of different color, reposing in individual "pans" or containers within the compact characterized by an absence of dividing walls or partitions to separate the segments one from the other(s), i.e. the multiple segments are contiguous with respect to each other in each pan, respectively.

BACKGROUND ART

The conventional method of making articles of the foregoing type, viz. containers of contiguous muti-colored segments of compressed powder cosmetic material, comprises first forming a small, shallow pan, usually of a durable, easily formed material such as aluminum, for example, and arranging a multiplicity of such empty pans on a work surface to form a juxtaposed array of rows and columns. A first pattern or mask having perforations corresponding to the shape and location of a first colored segment is positioned over the array of pans and loose cosmetic powder is poured into the pans through the perforations in the mask. A second mask having perforations corresponding to the shape and location of a second colored segment in each pan is then substituted for the first mask and loose powder of a second color is poured through the perforations in the second mask. This process is continued with as many different perforated masks and colored powders of cosmetic material as there are colored segments desired to be in each pan. The pans are then moved to a conventional pressing station where one-by-one the powder in each pan is compressed under a flat piston having a shape corresponding to the pan. One disadvantage of this prior method is that the use of a series of different perforated masks corresponding to the different colored segments in each pan is tedious and time consuming thereby limiting the speed in which the multi-colored segmented pans of compressed cosmetic powder may be formed. This, in turn, leads to a relatively high unit cost of such items to the consumer. In addition, the use of such masks makes it extremely difficult, if not impossible, to produce sharp and uniform lines of demarcation among the final pressed multi-colored segments in each pan.

DISCLOSURE OF THE INVENTION

Against the foregoing background, it has been discovered in accordance with the present invention that segmented cosmetic articles may be made without the aforementioned disadvantages by positioning an empty pan at the bottom of a sleeve having an interior partition or partitions such that a transverse cross-section of the sleeve including partitions yields a pattern congruent to that of the multi-colored segmented pattern of the desired cosmetic article. The partition or partitions form separate compartments or chambers extending longitudinally the full extent of the sleeve, with each compartment being adapted to receive a corresponding charge of loose powder (each preferably of different color) through the end of the sleeve distal with respect to the pan. A ram or piston assembly having solid segments corresponding in shape to each separate chamber then is slidably received within the sleeve through the opening through which loose powder is admitted, and telescopically advanced relative to the sleeve toward the pan at other end thereof sufficient to pre-press or partially compress the powder charge into the pan. By this action, all segments of powder corresponding to the charge in each chamber of each sleeve, respectively, are partially compressed simultaneously. The sleeve is then moved telescopically relative to the piston assembly away from the pan and the pre-pressed segments therein thereby permitting the pan to be indexed to a second pressing station where a piston having a shape congruent to the shape of the pan mouth is moved toward the pan to finally compress the pre-pressed multi-colored segments therein. By this method, a pan having contiguous multi-colored segments demarcated by sharp, uniform lines of color transition in any desired pattern or arrangement of color may be produced in a high-speed, efficient, and relatively low cost manner.

BRIEF DESCRIPTION OF THE DRAWINGS

The foregoing and additional advantages and objectives of the present invention will become more apparent from a study of the following more fully detailed description of same in connection with the accompanying drawings in which:

FIG. 1 is a perspective view of a preferred form of cosmetic compact made in accordance with the present invention;

FIG. 2 is a perspective exploded view of the preferred form of apparatus for making the cosmetic articles employed in the compact of FIG. 1;

FIG. 3 is a sectional view in elevation of the sleeve portion of the apparatus of FIG. 2 showing empty pans attached to the bottom extremity thereof;

FIG. 4A is the same view as FIG. 3 after the loose powder feeding step;

FIG. 4B is a sectional plan view taken along line 4B — 4B of FIG. 4A;

FIG. 5A is a sectional view in elevation of a further portion of the apparatus of FIG. 2 showing the pre-press ram slidably received with the sleeve of FIG. 3;

FIG. 5B is a sectional plan view taken along line 5B - 5B of FIG. 5A;

FIG. 5C is a perspective rendering of the cosmetic article made in accordance with the invention after the pre-pressing step;

BEST MODE OF CARRYING OUT THE INVENTION

Figure 7:
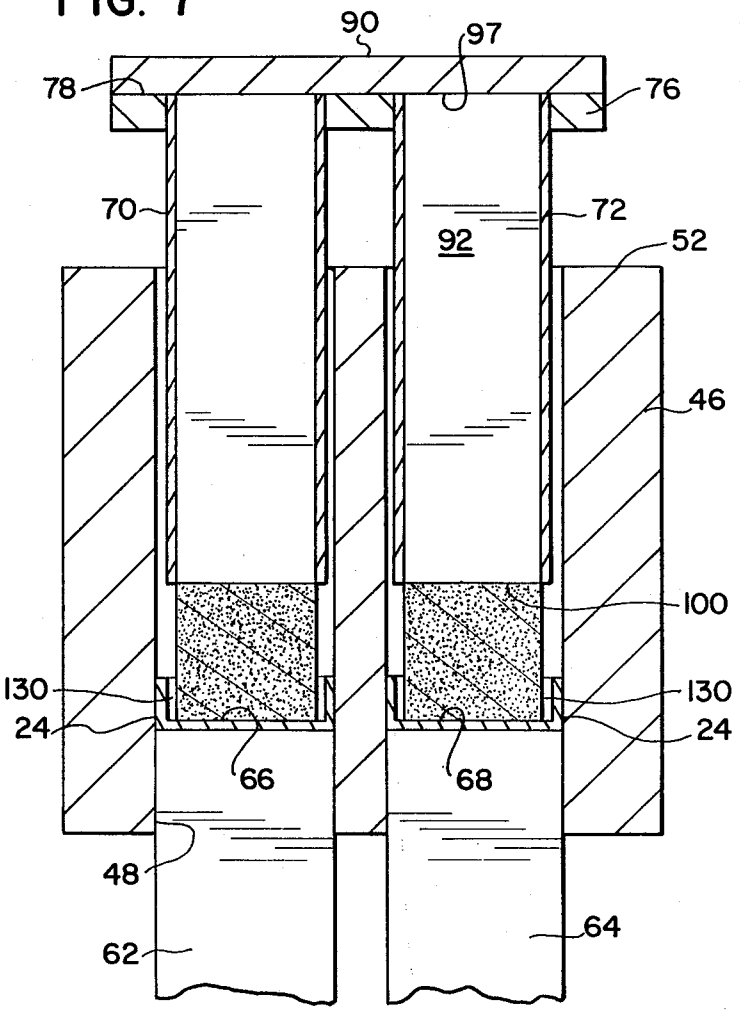
FIG. 7 is the same view as FIG. 6 showing the disposition of the sleeve following the pre-pressing step.

Referring initially to FIG. 1, there is shown a preferred form of compact 10 including cosmetic material made in accordance with the principles of the present invention. Compact 10 comprises a base 12 and a cover 14 attached to the base via a conventional hinged connection 16 permitting the cover to be swingable relative to the base between the open position shown and a closed position (not shown). A detent 18 is provided engageable with slot 20 to maintain the cover closed relative to the base when the compact is not in use. A mirrored surface 22 optionally may be affixed to the inside of cover 14 substantially as shown to facilitate application of the cosmetic material contained within the compact. Such cosmetic material preferably comprises compressed powder eyeshadow, but it will be understood that any other compressed powder cosmetic material such as cheek blush, foundation, face powder, or rouge may be employed instead.

In the preferred embodiment illustrated, the eyeshadow reposes in a pair of identical, rectangularly shaped, shallow pans 24 fabricated preferably of metallic material (e.g. aluminum), which, in turn, are receivably secured within similarly shaped receptacles 26 in surface 28 of base 12 as by press-fit, or the use of a suitable adhesive, all as is well known in the art. By this arrangement, the exposed surface of the cosmetic material contained within pans 24 is flush with or recessed slightly below the plane of surface 28, as substantially shown. To further facilitate application of the cosmetic material in pans 24 to the surface of the skin, a conventional applicator featuring a handle 30 and an integral spongy tip 32 is stored in a suitably sized recess 34 in surface 28 adjacent receptacles 26 more or less as depicted.

In the specific preferred embodiment illustrated, the cosmetic material in pans 24 consists of compressed powder eyeshadow arrayed in a pattern of three triangular-shaped, contiguous segments 36, 38, 40 each having a different color. Lines 42, 44 thus diagrammatically represent the transition of one color to another between segments 36, 38 and between segments 38, 40, respectively.

As contemplated by the present invention, pans of compressed powder cosmetic material having characteristic patterns of contiguous segments of different color may be made in a novel and efficient manner. Thus, turning now to FIGS. 2–9B, the preferred apparatus and method of making such cosmetic articles will now be described in detail. At the outset, it will be appreciated that the preferred apparatus and method to be described are especially adapted for making pans of cosmetic material having the triangular-shaped segmented pattern shown in FIG. 1, but that other shapes and/or patterns may be made without departing from the principles of the present invention.

Referring initially to FIG. 2, where the various components of the preferred apparatus are shown, there is depicted a cylindrical work-piece holder 46 having a pair of identical spaced cavities 48, 50 each of which extends longitudinally parallel to the central axis of the work-piece between the latter's top surface 52 and its opposed or bottom surface 54, and each of which opens into these opposed surfaces, respectively. For reasons which will become more apparent below, each cavity 48, 50 has a transverse cross-sectional shape substantially the same as that of pan 28 so than an individual pan 28 may be snugly received therein (see FIG. 6).

An elevator block 56 has a central slot 58 terminating above bottom surface 60 to define a pair of bifurcated portions 62, 64 each having a top flat surface 66, 68, respectively. The bifurcated portions 62, 64 each have the same transverse cross-sectional shape as cavities 48, 50, but are dimensioned slightly less so as to be snugly, slidably received within cavities 48, 50 through the latters' openings in surface 54. When elevator block 56 is so positioned relative to work-piece holder 46, top flat surfaces 66, 68 are adapted to support pans 24 thereon (FIGS. 6–9). In practice, work-piece holder 46 is fixed and elevator block 56 adapted to be slidable therein as will be more fully described. To facilitate relative slidable movement between these parts, the bottom surface 60 of elevator block 56 carries an integral boss 62 for connection to a suitable conventional motion translation device (e.g., crank-arm, solenoid, hydraulic piston) not shown and the details of which form no art of the present invention.

Adapted to be positioned above work-piece holder 46 and inserted into cavities 48, 50 through the latters' openings in surface 52 is a sleeve assembly comprising a pair of identical hollow, rectangularly shaped sleeves 70, 72 integrally fixed to the bottom surface 74 of a cylindrical disk 76 which serves as a flanged support for the sleeves. The interior of each sleeve is divided into three, triangular-shaped compartments 80, 82, 84 by a pair of diagonally extending partitions or dividers 86, 88 with the compartments and the partitions extending the entire longitudinal extent of the sleeve between a pair of opposed openings, one of which is located at the distal end of the sleeves and the other of which communicates with top surface 78 of flanged disk 76.

Figure 6:
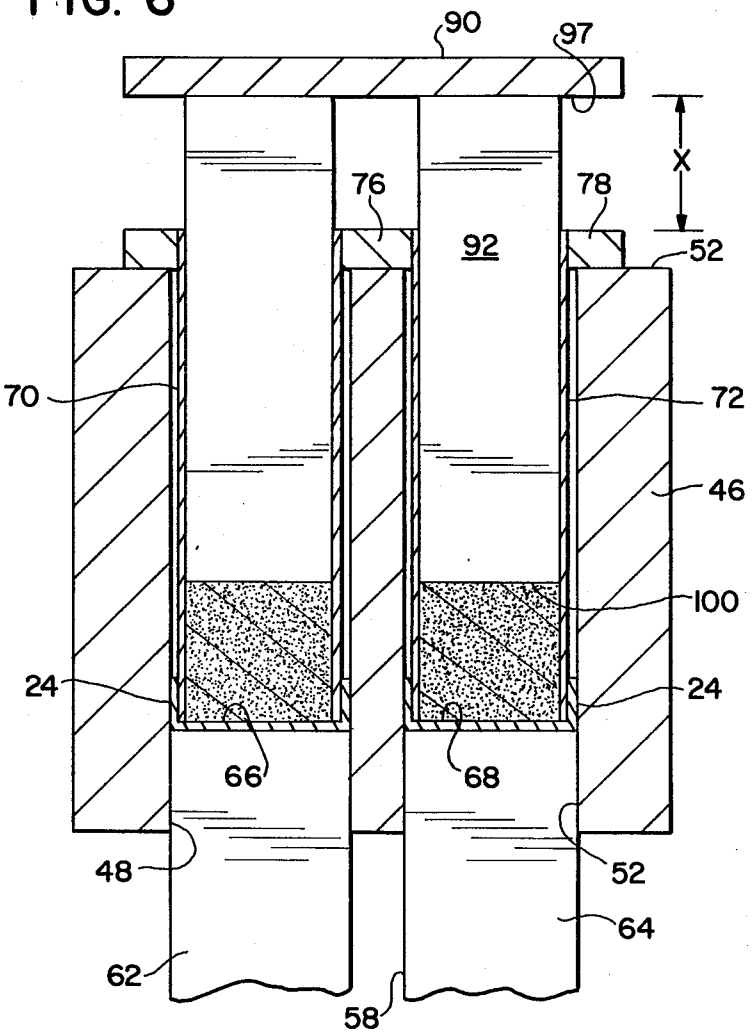
FIG. 6 is a sectional view in elevation of a still further portion of the apparatus of FIG. 2 showing the pre-pressing step.

The external dimensions of each sleeve 70, 72 and the spacing between the sleeves are such as to facilitate slidable insertion thereof into cavities 48, 50 substantially as shown in FIGS. 6 and 7. As best seen in FIGS. 4B and 6, the disposition of partitions 86, 88 interiorly of the sleeves and the cross-sectional shape of the rectangular sleeves per se together produce a configuration substantially identical to the pattern of triangular segments 36, 38, 40 in the pan 24 of cosmetic material illustrated in FIG. 1.

A pre-pressing ram assembly comprising second flanged disk 90, and a pair of spaced clusters of parallel extending solid, triangular-shaped segments 92, 94, 96 integrally attached to the disk's bottom surface 97 and depending downwardly therefrom (as viewed in FIG. 2) is adapted to cooperatively and telescopically engage the aforedescribed sleeve assembly. In transverse cross-section, the three segments in each of said pair of clustered segments are rectangularly shaped, but are divided into their separate triangular shapes by diagonally extending slots running the entire longitudinal extent thereof. Segments 92, 94, 96 and slots 104, 106 in said pair are sized and shaped in such a manner as to facilitate snug, sliding movement of the segments within the interior compartments of sleeves 70, 72 of the sleeve assembly substantially as shown in FIGS. 5A and 5B. That is, triangular segments 92, 94, 96 of the pre-press ram assembly are snuggly slidable in compartments 80, 82, 84 of the sleeve assembly, respectively, with partitions 86, 88 being snugly, slidably received within slots 104, 106, respectively, when disks 90 and 76 are moved relative to each other. The distal bottom surfaces 98, 100, 102 of each triangular-shaped segment in each of said pair of clustered segments preferably are flat and when the pre-press ram assembly is slidably telescopically engaged with the sleeve assembly, such flat surfaces extend normal to the central axis of each sleeve and to the direction of relative movement between the sleeve assembly and the ram assembly. By this arrangement, and as will be explained more fully below, surfaces 98, 100, 102 function as piston heads to compress loose cosmetic powder disposed within the compartments or chambers 80, 82, 84 of the sleeve assembly. Moreover, it will be appreciated that flat surfaces 98, 100, 102 substantially conform in size and shape to the planar extent of segments 36, 38, 40 of cosmetic material in pan 24 of FIG. 1, but do not exactly conform as will be explained later.

The final component in the apparatus of the present invention comprises the final-press ram assembly which is composed of a third flanged disk 108 having a pair of solid, parallel extending, spaced rectangular shaped segments 110, 112 integrally attached to and depending from the bottom surface 114 of the disk. The solid segments 110, 112 terminate in preferably flat, distal end surfaces 116, 118, respectively, and are adapted to be inserted for snug sliding movement within cavities 48, 50 of work-piece holder 46 through the cavities' openings in top surface 52 such that surfaces 116, 118 confront surfaces 66, 68 on the elevator block 56, and are adapted to move normal to the work-piece holder's central axis when disk 108 is advanced in the direction of surface 52. Toward this end, each segment 116, 118 has a transverse cross-sectional shape and size conforming to the rectangularly shaped top surface of the cosmetic material in pan 24 (see FIG. 8). A boss 120 or similar appendage located on the top surface of disk 108 is provided to facilitate connection to a conventional motion transmitting device (not shown) such as a crank-arm, solenoid, hydraulic piston, and which device may be employed to move the final-press ram assembly telescopically relative to the workpiece holder 46.

In accordance with the invention, the various components of the apparatus described above are employed in conjunction with certain of the others in a manner and in a sequence of steps as will now be explained in detail with particular reference to FIGS. 3–9B.

Initially, a pair of empty pans 24 are affixed to the distal bottom ends of the sleeve assembly in the positions shown in FIG. 3. The sleeves 70, 72 are dimensioned in such a manner that the sidewalls of each pan will flex slightly when inserted about the extremities of the sleeves thereby effecting a resilient gripping action tending to maintain the pans securely in place on the sleeves substantially as shown, i.e. there is a slight interference fit between the outside of the sleeve and the inside surface of each pan's sidewalls. The sleeve assembly with empty pans attached is then moved under a series of three hopper funnels 122, 124, 126 (FIG. 9A) where a predetermined charge of loose cosmetic powder (e.g. eyeshadow) is fed into each compartment 80, 82, 84 of the sleeve through a corresponding opening in surface 78. Preferably, each funnel will dispense a charge of differently colored powder; however, it will be understood that two of the colors may be the same, or that all three colors may be identical; or that the funnels may dispense different forms of cosmetic material, i.e. eyeshadow in one compartment, cheek blush in another, and so on.

The sleeve assembly having the pans attached at the bottom extremity thereof and the loose powder charges in each compartment (FIG. 4A) is then moved into position over the work-piece holder 46 and elevator block 56, and inserted axially into cavities 48, 50 until the pans bottom on surfaces 66, 68, and the bottom surface 74 of flanged disk 96 engages top surface 52 of the workpiece holder. See FIG. 6.

The pre-press ram assembly is then positioned over the sleeve assembly and segments 92, 94, 96 slidably inserted into compartments 80, 82, 84, respectively, in each cavity. The pre-press ram assembly is then telescoped or moved in an axial direction relative to pans 24 and work-piece holder 46 until flange 90 is spaced a distance "X" from flange 76 sufficient to cause surfaces 98, 100, 102 to partially compress the loose powder in each compartment relative to pans 24 and the bottom portion of the sleeve assembly substantially as shown in FIG. 6. When this is done, sufficient partial compression is effected to produce a stable block of cosmetic material in each pan 24, but having an upper surface extending beyond (above) the sidewall top edge of each pan. The extent of axial movement of the pre-press ram assembly relative to the sleeve assembly (i.e. the length of stroke of segments 92, 94, 96 in compartments 80, 82, 84) required to achieve formation of a stable block of partially compressed cosmetic material in each pan will depend upon the type of cosmetic material employed and changes in stroke may be made to accommodate such variations. Suffice it to say, the distance "X" is selected to produce a block of partially pressed cosmetic material which, if left free-standing in pan 24, will maintain its dimensional stability.

After the pre-pressing step, the sleeve assembly next is withdrawn from pans 24 relative to the work-piece holder and the pre-press ram assembly by axially moving flange 76 upward as viewed in FIG. 6 a distance "X" or until upper surface 78 of flange 76 engages lower surface 97 of flange 90 of the pre-press ram assembly. This position is shown in FIG. 7 where, it will be observed, the distal extremities of both the sleeve assembly and the pre-press ram assembly are in alignment with each other and with the top surface of the stable blocks of pre-pressed powder reposing in pans 24. If the pans were removed from the work-piece holder at this juncture they would appear as shown in FIG. 5C. Thus, the pre-pressed block of cosmetic material comprises three triangular-shaped segments **36*a*, 38*a*, 40*a* separated by slots 86*a*, 88*a* formed therein as a result of dividing walls 86, 88 in each sleeve of the sleeve assembly with the slots having the same thickness or traverse dimension as that of each corresponding dividing wall. In addition, there exists a gap 130 between the block and the sidewall inner surface of each pan 24 extending along the entire periphery of the block due to the thickness of the withdrawn sleeves 70, 72**.

Figure 9B:
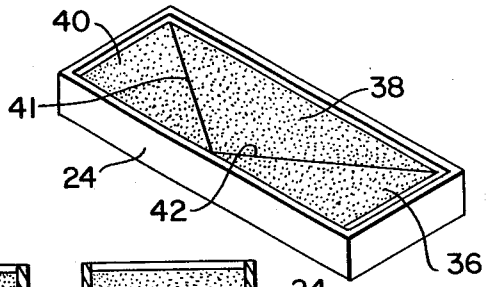
FIG. 9B is a perspective rendering of the cosmetic article made in accordance with the invention after the ejection step.
Figure 9A:
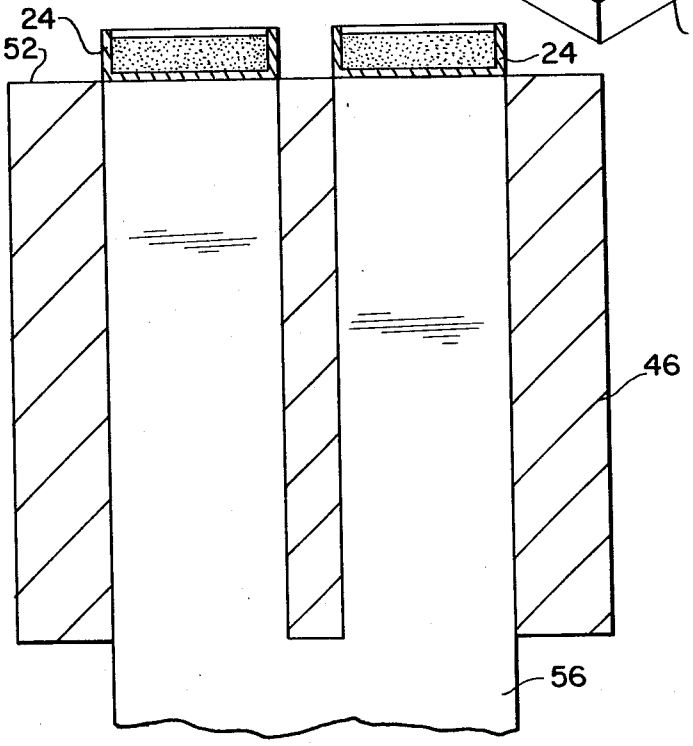
FIG. 9A is the same view as FIG. 8 showing the final pressing ram withdrawn and the elevator in the final ejecting position.
Figure 8:
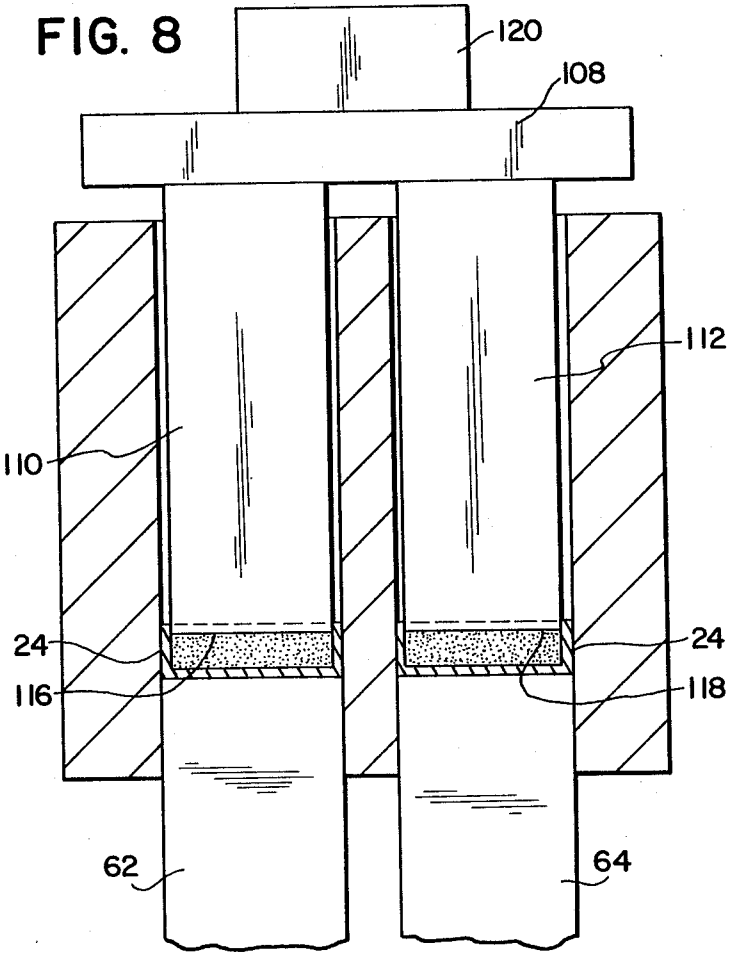
FIG. 8 is a sectional view in elevation of yet still a further portion of the of the apparatus of FIG. 2 showing the final pressing step.

In order to transform the pre-pressed block of FIG. 5C into the final pressed "cake" of FIG. 1, the sleeve assembly and the pre-press ram assembly are withdrawn from the work-piece holder by simultaneous axial movement of these parts in the upward direction as viewed in FIG. 7. The final-press ram assembly is then positioned over the work-piece holder and segments 110, 112 telescopically inserted into cavities 48, 50, respectively. Flange 108 is then caused to be axially moved downward relative to the work-piece holder, the elevator block, and the pair of partially pressed cosmetic powder blocks to the position shown in FIG. 8. By this action, piston surfaces 116, 118 compress the pre-pressed block of cosmetic powder in each pan 24 to its final condition as shown in FIGS. 1 and 9B. The final-press ram assembly is then moved upwardly as viewed in FIG. 8 withdrawing segments 110, 112 from cavities 48, 50. Finally, the elevator block is raised relative to the work-piece holder bringing the finally pressed pans 24 to the position shown in FIG. 9 where surfaces 66, 68 are flush with top surface 52 of the work-piece holder. The ejected final-pressed powder pans may then be removed for assembly inside compact 10.

As a result of the final pressing step, the partially pressed block of cosmetic powder in each pan 24 (FIG. 5C) is compressed tightly into the pans so that the top surface of the powder lies slightly lower than the upper edge of each pan, and the slots **86*a*, 88*a* as well as the peripheral gap 130 are completely filled in with suitably compressed cosmetic powder. The final article thus appears substantially as shown in FIG. 9B with the sharp, distinct and uniform lines of color transition 42, 44 being present in the locations formerly occupied by slots 86*a*, 88*a***.

It will be recalled in accordance with the present invention, that the pre-pressed block of cosmetic material shown in FIG. 5C is produced when the sleeve assembly is indexed the distance "X" upwardly relative to the pre-pressing ram assembly which remains fixed. When this occurs, the piston surfaces 98, 100, 102 of triangular segments 92, 94, 96 are in contact with the top surfaces of segments **36*a*, 38*a*, and 40*a* thereby helping to precisely maintain the dimensions of the pre-pressed block of cosmetic powder during withdrawal of the sleeve assembly, and further, helping to maintain pans 24 in a stable position during such withdrawal. In an effort to further assure a smooth withdrawal of the sleeve assembly from each pan, the latter preferably are dimensioned to have a slight interference fit with the walls of cavities 48, 50 as this will produce a gripping contact between the cavities' walls and the exterior of the pans tending to maintain the pans in place during the aforementioned sleeve withdrawal step. The precision and quality of the finally pressed article will be influenced by the degree in which the pre-pressed block of FIG. 5C** maintains its dimensional stability during and after being formed, an objective manifestly achieved by the apparatus and method of the present invention.

In order to verify the present invention, a model of the above-described apparatus was constructed in which stock rectangular aluminum pans having a thickness of 0.015 inches and dimensions of 1.455 x 0.578 x 0.140 inches were filled with compressed powder eyeshadow having a segmented pattern substantially as shown in FIGS. 1 and 9B. In such model the cavities 48, 50 in the work-piece holder 46 had dimensions of 1.455 x 0.578 inches; the sleeve assembly rectangular cross-section (sleeves 70 or 72) measured 1.4195 x 0.5410 inches and had an axial length measured from surface 78 of disk 76 to the bottom distal extremity of each sleeve of 3.5 inches; the pre-press ram assembly solid segments had an axial extent measured from the bottom surface of disk 90 of 4.0 inches; the length of stroke "X" used to form the partially pressed blocks of cosmetic powder was 0.5 inches; and the cross-sectional dimensions of the solid segments of the final-press ram assembly were 1.44 x 0.563 inches. The loose powder charges in each compartment of the sleeve assembly were of different color, respectively, and the final articles of compressed powder eyeshadow displayed sharp and uniform lines of color transition between each pair of contiguous triangular-shaped segments.

While preferred embodiments of the present invention have been described in detail as required by statute, it is apparent that many variations and modifications may be made without departing therefrom. For example, the configuration of the segmented pattern and/or the number of segments in each pattern in the final pressed article may be varied at will as long as the transverse cross-sectional shape of the sleeve assembly and the pre-press ram assembly are similarly varied to conform to the desired pattern. This may be done quite easily by merely changing the shape, number and relative disposition of the dividing walls or partitions inside each sleeve. For example, arcuate dividing walls, as viewed in the transverse cross-section of the sleeve and the walls, may be used either alone or in combination with straight dividing walls to produce a complex pattern as desired. All that is necessary is that the solid segments in the pre-press ram assembly be configured to have a transverse cross-sectional shape conforming to and congruent to the transverse cross-sectional shape of the resulting compartments formed interiorly of each sleeve by the partitions or dividing walls however configured.

Furthermore, although the apparatus described above comprises two cavities for making two pans of pressed cosmetic material simultaneously, it will be appreciated that the number of cavities and therefore the number of pans being pressed simultaneously in accordance with the invention is a matter of choice depending upon capacity needs.

Also, although the distal extremities of the pre-press ram assembly and of the final-press ram assembly are preferably flat (and smooth), it will be appreciated that these distal surfaces, which serve as piston heads for partially compressing and finally compressing the powder into pans 24, may be concave or convex relative to a transverse plane normal to the direction of compression, so as to produce a domed or dished surface, respectively, in the final pressed article; or these distal extremities may have a textured surface such as, for example, a layer of textured fabric co-extensively attached thereto, or alternatively, they may have a textured pattern engraved directly onto the surface thereof, effective to impart a correspondingly textured pattern to the exposed surface of the powder contained in the finally pressed pans 24.

Moreover, it will be understood that various steps may be taken to even more fully automate the method described above such as, for example, mounting a plurality of multi-cavity work-piece holders on a moving conveyor belt or a rotary table and providing automatic means for manipulating the sleeve assembly, the pre-press ram assembly, the final-press ram assembly, and/or the elevator block in conjunction with such automated means.

Finally, although in the preferred apparatus the pre-press ram assembly and the final-press ram assembly are disclosed as being axially and telescopically movable with respect to the pans 24 and the elevator block 56, it will be understood that it is the relative motion between and among these parts that is significant, and that accordingly, it is entirely conceivable that the same assemblies may remain fixed in cavities 48, 50 following initial insertion whereupon elevator block 56 instead may be advanced upwardly as viewed in the drawings relative to each ram assembly to accomplish the pre-compression and final compression steps, respectively.

Therefore, it is desired that the present invention be limited only by the true spirit and scope of the appended claims.

We claim:

1. Apparatus for making segmented compressed powder articles comprising:

means for containing compressed powder, means for storing powder to be compressed in separate compartments, and means cooperatively engaging said storing means, said cooperatively engaging means being adapted to compress said powder stored in said separate compartments into said containing means whereby said powder in said separate compartments forms contiguous segments of compressed powder in said containing means, said storing means including separate compartments having at least a first and second shape and said contiguous segments of compressed powder in said containing means conforming respectively to said first and second shape, said containing means comprising a shallow pan and said storing means comprising a sleeve having at least one dividing wall therein to form at least first and second compartments interiorly of said sleeve, said cooperatively engaging means being adapted to cause powder in said first and second compartments to be compressed into said shallow pan, means for supporting said pan relative to said sleeve, said cooperatively engaging means comprising piston means having separate portions disposed in said first and second compartments, said separate portions being shaped to conform to the shape of said first and second compartments, respectively, and adapted to be slidable relative to and within said sleeve, means for moving said piston means relative to said sleeve sufficient to form a block of partially compressed powder in said sleeve, and means for moving said sleeve relative to said piston means separate portions whereby the extremity of said sleeve is spaced from said pan at least by the distance said block of partially compressed powder extends beyond said pan, said relative movement occurring while said piston means separate portions remain in engagement with said partially compressed block of powder.

2. The apparatus of claim 1 further comprising separate piston means adapted to further compress said block of partially compressed powder relative to said pan.

3. The apparatus of claims 1, or 2 wherein said powder comprises cosmetic material.

4. The apparatus of claim 3 wherein said cosmetic material stored in each of said first and second compartments is of a different color.

5. The apparatus of claim 3 wherein said cosmetic material is selected from the group consisting of eyeshadow, face powder, cheek blush, and rouge.

6. The apparatus of claim 4 wherein said cosmetic material is selected from the group consisting of eyeshadow, face powder, cheek blush, and rouge.

7. The method of making segmented powder articles comprising the following steps:

(a) storing lose powder to be compressed in at least first and second compartments separated by a dividing wall, (b) compressing said powder into a receptacle disposed relative to said first and second compartments so as to produce segments of partially compressed powder in said receptacle corresponding to said first and second compartments, respectively, and wherein said segments are separated from each other by a distance corresponding to the thickness of said dividing wall, (c) compressing said segments relative to said receptacle so as to produce contiguous segments having a boundary line therebetween located in the space formerly occupied by said separation, and (d) disposing in each of said compartments loose cosmetic powder of a different color or other appearance, respectively, prior to step (b).

8. The method of claim 7 further comprising the step:

(d) disposing in each of said compartments loose cosmetic powder selected from the group consisting of eyeshadow, face powder, cheek blush, and rouge, prior to step (b).

9. The method of claim 7 further comprising the step of removing said dividing wall from between said separated segments prior to step (c).

* * * * *